US005532543A

United States Patent [19]

Van Der Leeuw et al.

[11] Patent Number: 5,532,543

[45] Date of Patent: Jul. 2, 1996

[54] HIGH DENSITY DISCHARGE LAMP WITH PINCHED-ON CONTAINMENT SHIELD

[75] Inventors: Bart Van Der Leeuw, Hammondsport; Albert E. Kowal, Savona, both of N.Y.; Henrikus J. H. Pragt, Eindhoven, Netherlands; Joseph E. Canale, Painted Post, N.Y.

[73] Assignee: Philips Electronics North America Corporation, New York, N.Y.

[21] Appl. No.: 126,820

[22] Filed: Sep. 24, 1993

Related U.S. Application Data

[63] Continuation-in-part of Ser. No. 994,572, Dec. 22, 1992.

[30] Foreign Application Priority Data

Dec. 23, 1991 [EP] European Pat. Off. ..... 91203379

[51] Int. Cl.[6] ..... H01J 17/28

[52] U.S. Cl. ..... 313/25; 313/324; 313/313; 313/571; 313/634; 313/642

[58] Field of Search ..... 313/25, 26, 46, 313/44, 580, 572, 571, 573, 634, 639, 643, 312, 313, 317, 642, 324; 362/186, 297, 350; 220/2.1 R

[56] References Cited

U.S. PATENT DOCUMENTS

| | | | |
|---|---|---|---|
| 2,845,557 | 8/1956 | Gottschalk | 313/25 |
| 4,709,184 | 11/1987 | Keeffe et al. | 313/638 |
| 4,721,876 | 1/1988 | White et al. | 313/25 |
| 4,888,517 | 12/1989 | Keeffe et al. | 313/25 |
| 4,929,863 | 5/1990 | Verbeek et al. | 313/113 |
| 4,950,938 | 8/1990 | Ramaiah | 313/25 |
| 4,963,790 | 10/1990 | White et al. | 313/25 |
| 5,039,912 | 8/1991 | Van Vliet et al. | 313/25 |
| 5,043,623 | 8/1991 | Scholz et al. | 313/25 |
| 5,109,181 | 4/1992 | Fischer et al. . | |
| 5,136,204 | 8/1992 | Muzeroll et al. | 313/25 |
| 5,309,058 | 5/1994 | Heindl et al. | 313/25 |

FOREIGN PATENT DOCUMENTS

| | | |
|---|---|---|
| 0186899 | 7/1986 | European Pat. Off. . |
| 0361530 | 4/1990 | European Pat. Off. . |
| 0475381 | 3/1992 | European Pat. Off. . |
| 2201860 | 8/1990 | Japan . |

OTHER PUBLICATIONS

Electric discharge lamps, Dr. John Waymouth, 1988.
Venture lighting Co, Cleveland, OH, 1991, pp. 16–17.

*Primary Examiner*—Sandra L. O'Shea
*Assistant Examiner*—Ashok Patel
*Attorney, Agent, or Firm*—Brian J. Wieghaus

[57] ABSTRACT

An electric discharge lamp has a discharge vessel including pair of opposing planar seals each having a pair of major faces and a pair of minor, side faces. A containment shield surrounds the discharge vessel and includes a glass sleeve and a helically coiled wire secured on the glass sleeve. The glass sleeve is pinched to bevelled ends of the minor, side faces of the seals only and substantially does not engage the major faces of the seal. The wire is fixed around the sleeve in an electrically floating manner, e.g. by clamping fit. With the sleeve secured to the discharge vessel, MH quality photometrics are obtained with a tubular body arc tube without an end coat. The construction of the lamp is simple and effective to protect the outer bulb from being damaged by an explosion of the discharge vessel, and to prevent sodium from disappearing from the discharge vessel as a result of photoemission.

22 Claims, 3 Drawing Sheets

HIGH DENSITY DISCHARGE LAMP WITH PINCHED-ON CONTAINMENT SHIELD

CROSS-REFERENCE TO RELATED APPLICATIONS

This is a continuation-in-part of U.S. application Ser. No. 994,572 filed Dec. 22, 1992 entitled "Electric Discharge Lamp" of Henrikus J. Pragt which discloses and claims a discharge lamp with a containment sleeve having a coiled spring wire. The invention further relates to U.S. application Ser. No. 08/126,834, now allowed, of Bart van der Leeuw et al. entitled "High Pressure Discharge Lamp Having Filament Electrodes". The invention also relates to U.S. application Ser. No. 08/126,835, now U. S. Pat. No. 5,402,033, of Bart van der Leeuw et al., entitled "High Pressure Discharge Lamp Having Clamped-On Containment Sleeve" which discloses and claims a high pressure discharge lamp having a containment sleeve secured to the discharge vessel by electrically isolated clamping leads extending from the discharge vessel seals.

BACKGROUND OF THE INVENTION

The invention relates to a high pressure discharge lamp comprising:

an outer envelope;

a discharge vessel arranged within the outer envelope, the discharge vessel including a body portion enclosing a discharge space, an opposing pair of discharge electrodes within said body portion between which a discharge is maintained during lamp operation, and a pair of opposing seals sealing the discharge vessel in a gas-tight manner, each of the seals having a pair of opposing major faces and a pair of minor, side faces extending between the major faces;

frame means for supporting the discharge vessel within the outer envelope and for electrically connecting the discharge vessel to a source of electric potential outside of the lamp envelope; and a light-transmissive sleeve disposed about the discharge vessel and having an end pinched to a said seal.

Such a lamp has been publicly disclosed by Venture Lighting Company of Cleveland, Ohio as a metal halide lamp in 70 W and 100 W sizes. The sleeve and discharge vessel for this lamp are shown in FIG. 1.

The purpose of the containment sleeve 1 is to contain fragments of the discharge vessel 2 and prevent failure of the outer envelope (not shown) in the rare event of discharge vessel rupture. It is also generally known, for example, from U.S. Pat. No. 4,888,517 (Keefe et al.) that such a sleeve can also increase the temperature of the discharge vessel, leading to improved efficacy and color rendering. Such lamps are intended for open fixtures which do not have a separate cover to contain the glass fragments should the lamp outer envelope fail. One end 3 of the sleeve is open while the other end 4 is pinched to both major faces of one of the press seals 5. The discharge vessel is of the formed body type in which the body portion 6 of the discharge vessel, which lies between the press seals and in which the discharge is maintained between discharge electrodes 7, has a precise elliptical or ovoidal shape.

U.S. Pat. No. 5,136,204 discloses an alternative construction for supporting a sleeve about a discharge vessel. Metal clips are secured on the press seals and include portions which hold the ends of the sleeve. The sleeve and discharge vessel are supported by welding the clips to an elongate metal support rod which is fixed around the lamp stem by a metal strap. The support rod, and consequently the metal clips and the sleeve, are electrically isolated which prevents accelerated sodium depletion from the discharge vessel. (For a detailed description of this sodium loss process, reference may be made to the textbook *Electric Discharge Lamps* by Dr. John Waymouth, M.I.T. Press 1971 (Chapter 10)) As compared to a non-shielded lamp in which the elongate support rod typically extends from the lamp stem or is welded to a stem conductor to carry current to the discharge vessel, the fixing of the support rod to the stem with a metal strap is more expensive and intricate. The clips further add to the number of lamp parts and increase lamp cost. In the commercially available lamp according to this patent, the sleeve is quartz glass and has a wall thickness of 2 mm.

From U.S. Pat. No. 4,721,876 it is known to surround a glass containment sleeve with a meshwork of metal wire which is fixed around the tube with metal clamping strips. The meshwork increases the containment capability of the sleeve. The sleeve is supported by clamping strips which are electrically conducting and connected to a lamp frame which supports the discharge vessel and connects the discharge electrodes to a source of electric potential. The meshwork as a result is not electrically isolated, which can lead to the disappearance of sodium from the discharge vessel. The manufacture of the meshwork, or of a braided assembly, and its manipulation are also difficult. The clamping strips increase the number of lamp components and increases the number of welds in the lamp, which increases lamp cost. Extra metal parts attached to the lamp frame are also undesirable because it adds weight and increases the tendency of the frame to bend or fail if the lamp is dropped.

From this standpoint, the fusing of the sleeve to a portion of the discharge vessel as in the prior art lamp of FIG. 1 is advantageous because lamp manufacturing is simpler and no additional metal parts are introduced into the lamp envelope. However, as compared to designs which use straps or clips to hold the sleeve, the containment provided by the construction of the lamp of FIG. 1 was found to be insufficient. The wall thickness of the sleeve in the lamp of FIG. 1 was 2 mm. In tests in which the discharge vessel was ruptured by a current surge, failure of the outer envelope (not shown) was found to occur. Additionally, the sleeve construction is asymmetric in that the pinched end of the sleeve is totally closed whereas the other side is open. The lower side of the discharge vessel will thus have a significantly different temperature, and the lamp will have different photometrics, depending on whether the lamp orientation is base-up or base-down, which is undesirable. This asymmetry, however, is not present in the lamps according to the above-mentioned U.S. Pat. No. 4,721,876 and 5,136,204 in which both ends of the sleeve are open.

It is also known to use outer bulbs which have a larger wall thickness than standard bulbs to protect against failure in the event of discharge vessel explosion. However, using such non-standard bulbs greatly increases lamp cost.

During the early 1980's, interest in low wattage (35100 W) metal halide lamps rapidly developed, particularly as replacements for incandescent and halogen lamps for interior and display lighting. The first low wattage lamps were basically smaller versions of conventional higher wattage lamps. The discharge vessel was formed from a cylindrical tube of fused silica (i.e. quartz glass) with press seals at each end. Conventional rod and coil discharge electrodes of reduced size were arranged in the end chambers adjacent the press seal which resulted from the pressing process. The portion of the arc tube between the end chambers retained the circular cylindrical shape of the tube.

The performance of these early low-wattage lamps was inferior to the efficacy (LPW) and color rendering (CRI) values in the region previously established for higher wattage lamps (i.e., 150–400 W), especially in the smaller 35 W and 50 W sizes. It was found that luminous efficacy and color rendering generally worsened as the size and wattage of the discharge vessel were reduced. Later efforts to improve the performance of low wattage lamps concentrated mainly on discharge vessel shaping and miniaturization of the end chambers and press seals. Discharge vessels with precise elliptical or ovoidal discharge spaces resulted from these efforts. These discharge vessels, such as the type shown in FIG. 1, are of high quality but are more expensive than discharge vessels pressed from straight tubing. Shaping the formed body requires successive, time consuming glass working steps which are not required for straight-body discharge vessels.

In the early 1990's, the market calls for more cost effective low-wattage designs which can safely be used in open fixtures. However, cost reduced lamps will only be commercially successful if the photometrics of the lamps are acceptable. For low-wattage lamps to be considered of "standard quality" the initial efficacy (after 100 hours) should be greater than about 80 LPW for 100 watt lamps, greater than about 75 for 70 watt lamps and greater than about 65 for 50 watt lamps. The initial CRI should be greater than about 60 for each of these lamps.

SUMMARY OF THE INVENTION

It is an object of the invention to provide a high pressure discharge lamp of the kind mentioned in the opening paragraph which is of a simple, less costly and reliable construction while providing commercially acceptable photometrics.

According to the invention, this object is achieved in that a lamp of the type described in the opening paragraph is characterized in that:

the sleeve is fixed directly to the press seal along only the side faces thereof.

By fixing the sleeve against only the side faces of the press seal, both ends of the sleeve may remain open. Thus, the problems of asymmetry associated with pinching the sleeve along the major faces as in the prior art is obviated. The fixing may be accomplished by pinching, but other methods may also be suitable. Additionally, fixing the sleeve against the side faces, especially along the side faces of both seals, provides a sturdy construction in which clamping strips or clips can be eliminated. Thus, a simple, low cost, symmetric construction is obtained which overcomes the above-noted disadvantages in the prior art.

In a favorable embodiment, the sleeve is pinched against only the end portions of the side faces. This axially captures the discharge vessel within the sleeve while minimizing contact between the sleeve and discharge vessel so that cracking of the sleeve due to differences in thermal expansion between the sleeve and the discharge vessel is avoided.

According to another aspect of the invention, a helically coiled metal wire surrounds the glass sleeve and is fixed around this tube so as to be electrically floating. The helically coiled wire is significantly easier to handle then the known meshwork and can readily be assembled and secured on the sleeve without clamping strips. The coiled wire also permits the thickness of the sleeve to be reduced so that similar containment capabilities can be achieved with a containment shield which has about half the weight of the 2 mm sleeve known from U.S. Pat. No. 5,136,204.

This weight savings permits a construction according to another embodiment of the invention in which the discharge vessel and sleeve are supported within the outer envelope solely by the conductive feed-throughs extending from the seals being fixed to respective current-carrying support elements of the lamp frame which extend from the lamp stem. This provides a simple, low cost, light weight, readily manufacturable and sturdy lamp construction and avoids the use of extra clips and straps as in the prior art.

The helically coiled wire may be fastened to one of the current conductors by means of an electrically insulating bridge. An alternative possibility, however, is that the wire is fastened to the tube, for example, in that ends of the wire are fastened to the tube with cement or are fused into the tube.

A very attractive, convenient and reliable fastening is one in which the wire is fixed around the tube by its own clamping force. The wire has in that case been coiled on a mandrel with a smaller diameter than the tube, and has been twisted, for example against its coiling direction, during assembly so as to give its turn a larger diameter. After the wire has been applied around the tube, the twisting force is released and the wire will surround the tube with clamping fit.

In another favorable embodiment, the metal wire includes portions bent over the ends of the glass tube. The portions then axially secure the metal wire on the tube in a simple fashion. The wire may also have a clamping fit with the tube.

In spite of the comparatively great pitch which the wire may have, for example about 4 to about 9 mm, the wire provides a good electrical screening of the current conductor which runs alongside the discharge vessel and also on that account counteracts the disappearance of sodium, if this should be present in the discharge vessel. The construction provides a reliable protection against damage to the outer bulb in the case of an exploding discharge vessel. The influence on the luminous flux of the lamp is very slight.

In another embodiment of the invention, the lamp is a low wattage metal halide lamp in which the body portion of the discharge vessel between the end chambers is cylindrical, the discharge electrodes extend axially within the discharge vessel and include an electrode rod and coil overwind, and the end chambers of the discharge vessel are free of a heat conserving end coating. The term "low wattage" as used herein means a metal halide lamp having a rated wattage of about 100 W or less.

It was a surprise to find that "standard quality" performance could be achieved in a low wattage metal halide lamp with such a discharge vessel. This is because almost all commercially available metal halide lamps have a heat conserving end coating of, for example, zirconium oxide ($ZrO_2$) or aluminum oxide. Such coatings serve to increase the temperature of the discharge vessel, in the area at which the fill constituents condense, above that which is obtained solely by heating from the discharge arc to improve lamp photometrics. Of known low-wattage lamps which are commercially available and which have a cylindrical, or "straight" body discharge vessel, none are free of such a coating.

Elimination of the end coating results in significant cost savings and partially offsets the cost of providing the shield. It was another surprise to find that lumen maintenance was significantly improved without the end coating.

These and other objects, features, and advantages of the invention will become apparent with reference to the following drawings, detailed description, and claims.

DESCRIPTION OF THE PREFERRED EMBODIMENTS

Figure 2:
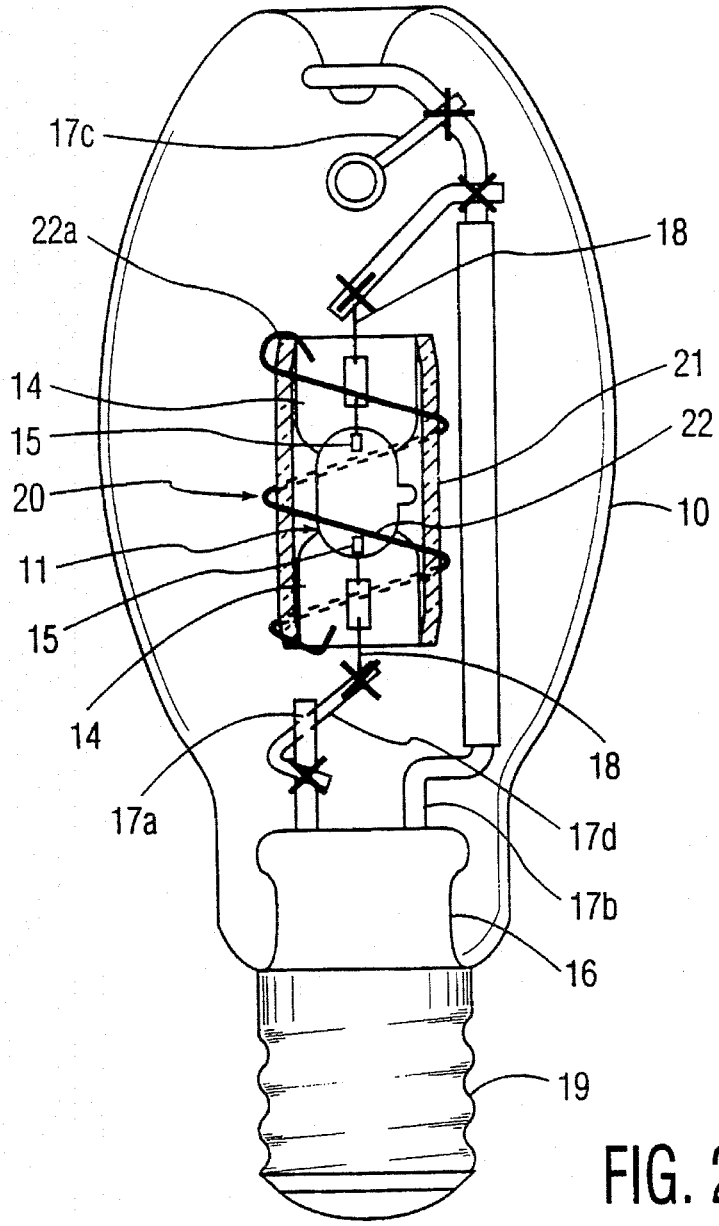
FIG. 2 illustrates a high pressure discharge lamp according to the invention having a containment shield with a light transmissive sleeve pinched to the press seals of the discharge vessel and a coiled wire with bent end portions bent over the sleeve ends.

FIG. 2 shows a high pressure discharge lamp having a sealed outer envelope 10 in which a discharge vessel 11 is arranged. Conductive support rods 17*a*, 17*b* extend from the lamp stem 16, in which they are sealed in a conventional manner, and are connected to lamp cap, or base, 19 outside the outer envelope and to respective ones of the discharge vessel feed-throughs 18 via conductive straps 17*c*, 17*d*. During lamp operation an electric potential is applied across the discharge vessel via the conductive support rods 17*a*, 17*b*, the straps 17*c*, 17*d*, and the feed-throughs 18 and a gas discharge is maintained between the discharge electrodes 15.

Figure 3:
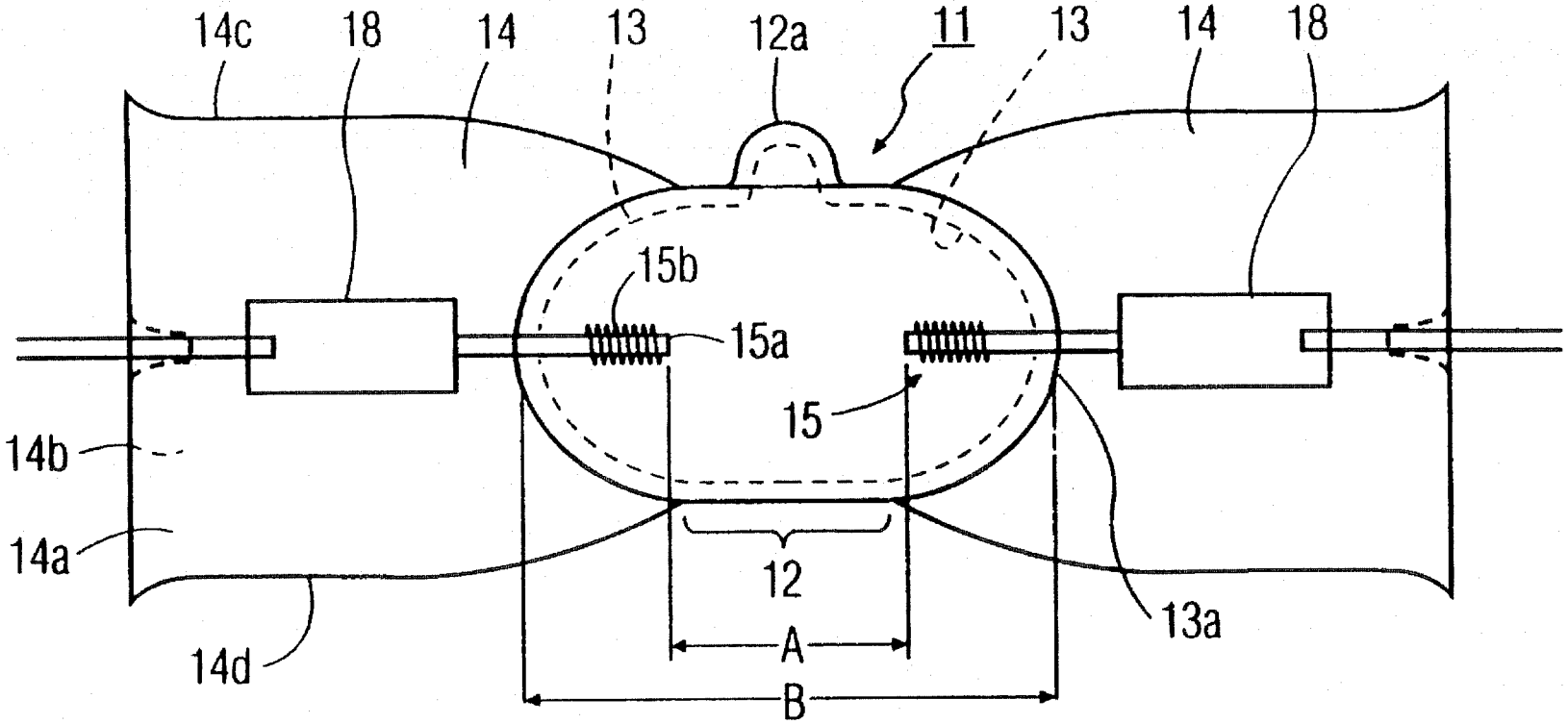
FIG. 3 is an elevation of the discharge vessel of the lamp of FIG. 2.

FIG. 3 shows the discharge vessel 11 in greater detail. The discharge vessel is formed from a length of straight circular-cylindrical tubing of fused silica (quartz glass) and includes opposing planar press seals 14, pressed in a conventional manner with press jaws, which seal the discharge vessel in a gas-tight manner. Between the press seals 14, the discharge vessel includes a central, tubular portion 12 of a constant circular cross-section and end chambers 13 of continuously reducing cross-section which result from the pressing of the seals 14. Each of the seals 14 has a pair of opposing major faces (14*a*, 14*b*) and a pair of minor, side faces (14*c*, 14*d*) extending between the major faces. The portion 12 further includes a tipped-off tubulation 12*a* from an exhaust tube which is used for exhausting and filling the discharge vessel in a known-fashion.

A discharge sustaining filling within the discharge vessel includes mercury, an inert gas and one or more metal halides. The discharge electrodes 15 are conventional and include an electrode rod 15*a* with a coil wrap 15*b*.

During lamp operation there is the very remote possibility that the discharge vessel may explode, for example, because of a power surge. Such explosions have been found to have sufficient force to rupture the outer envelope. In order to improve lamp photometrics and to contain fragments of the discharge vessel within the outer envelope, a containment shield 20 surrounds the discharge vessel and includes a vitreous light-transmissive sleeve 21 and a length of helically coiled wire 22 coiled about the sleeve. The sleeve may consist of, for example, hard glass or quartz glass (fused silica).

Figure 1:
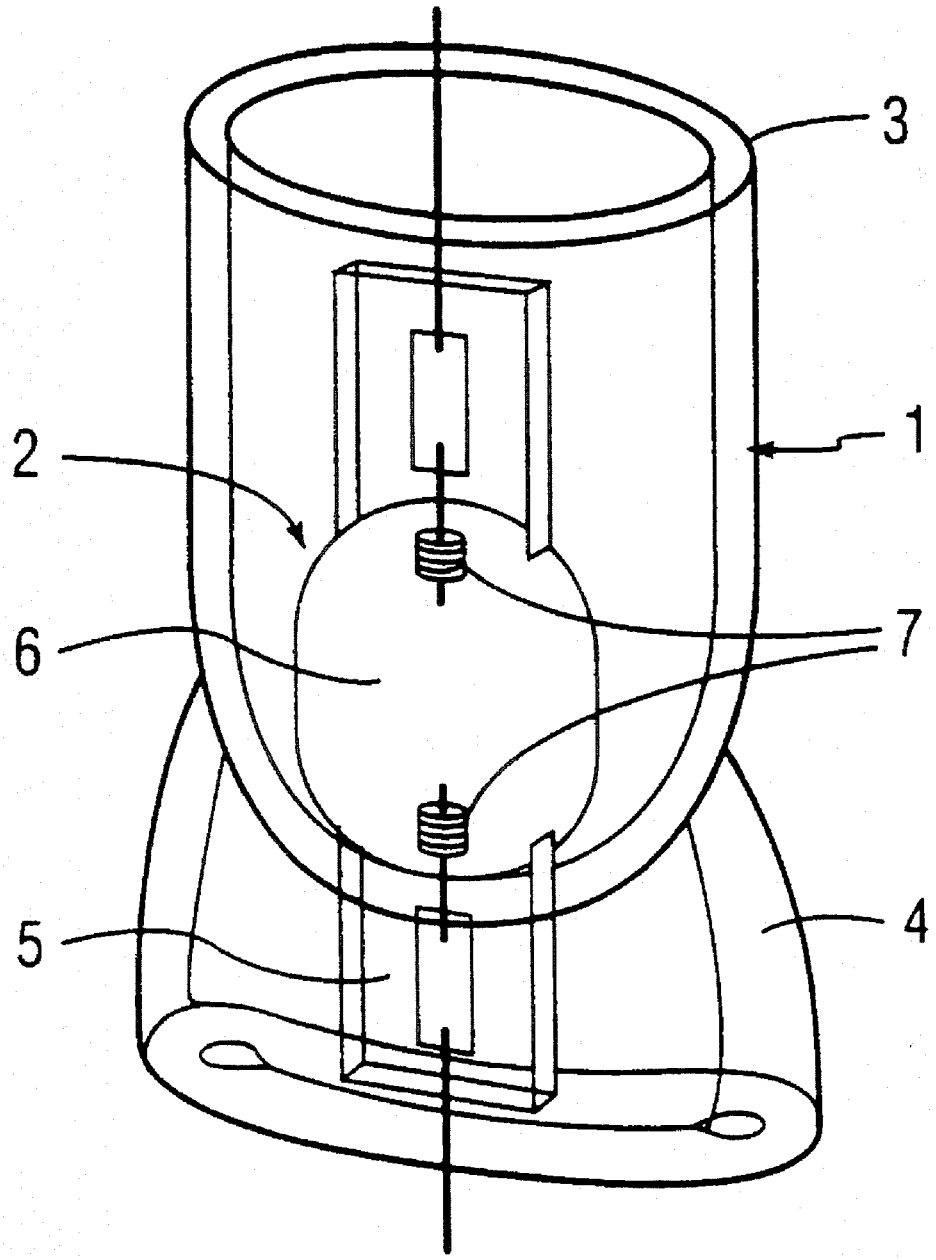
FIG. 1 PRIOR ART
FIG. 1 shows a metal halide discharge vessel/sleeve assembly according to the prior art having a formed-body discharge vessel and a containment sleeve pinched to one of the press seals at its major faces.
Figure 4:
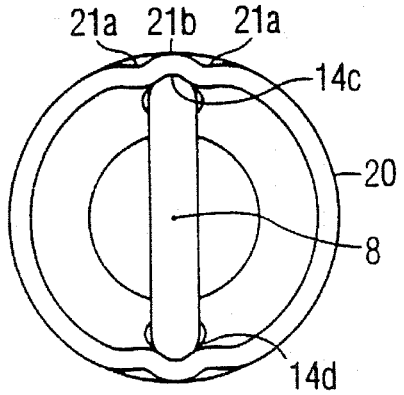
FIG. 4 is an end view showing the sleeve pinched to a press seal.

The sleeve 21 has an inner diameter, over a major portion of its length, which is only slightly larger than the largest width dimension between the side faces 14*c*, 14*d*, allowing the sleeve to be readily positioned over the discharge vessel. The ends of the sleeve are pinched against ends of the side faces of the press seals to axially capture the discharge vessel within the sleeve. This is accomplished by heating the ends of the sleeve opposite the minor seal faces 14*c*, 14*d* to its softening temperature and allowing it to just collapse onto the minor faces or by gently pressing the softened glass against the minor faces with suitable jaws. This may be done in a high speed manner. As a result of this, the sleeve includes indentations 21*a* which extend along the edge of the press seal side faces and portions 21*b* pressed against the end of the respective side faces. (FIG. 4) With the sleeve pinched against the ends or corners of the seal, which are the coolest part of the seal, less heat is conducted from the discharge vessel to the sleeve 21 than if the sleeve is fused across the major faces of the press seal as shown in the prior art lamp of FIG. 1. Additionally, both sleeve ends remain open and are symmetrical, so that the temperature distribution of the arc tube will be substantially the same whether the arc tube is operated base-up or base-down, in contrast to the prior art lamp of FIG. 1. Thus, the constructional advantages associated with pinching the sleeve to the press seals are retained while conduction of heat away from the discharge vessel is minimized.

The wire 22 is fixed around the sleeve by its own clamping force and is electrically floating. Bent end portions 22*a* engage over the ends of the sleeve to further axially secure it on the sleeve. To achieve this, for example, resistance wire may be used, for example, of kanthal, tantalum molydenum, or stainless steel. In the lamp shown, molybdenum wire of 0.60 mm diameter is used, coiled with a pitch of 5 mm. The coiled wire is thin and has an open structure. Influence on the luminous flux of the lamp, therefore, is scarcely perceivable.

The wire surrounding the tube is electrically floating. Disappearance of sodium, if present, from the discharge vessel is effectively counteracted by this. If an electron should be ejected from the wire by UV radiation, the wire is given a positive potential which slows down further electron losses.

It was found that the construction is sufficiently effective and reliable when the wire surrounds the pair of electrodes, i.e. the cavity of the discharge vessel, laterally.

The containment shield 20 is electrically isolated from the lamp frame because no metallic straps secure the sleeve to the conductive support rods 17 and neither the sleeve 21 nor the metal coiled wire 22 contact any portion of the metallic lamp frame.

Because of the helical wire, the tube may have a reduced wall thickness of, for example, about 1 mm and provide the same level of containment as the sleeve according to the above-mentioned U.S. Pat. No. 5,136,204, in which the commercially available embodiment had a wall thickness of 2 mm. With the coiled wire and the 1 mm sleeve, the containment shield 20 has a weight which is about half that of the prior art 2 mm sleeve. This weight reduction allows the sub-assembly of the discharge vessel and containment shield to be supported solely by the feed-throughs 18 and straps 17*c*, 17*d*. In the lamp shown, the feed-throughs 18 are 0.60 mm molybdenum wired the lower straps 17*d* is 0.025 mm by 0.16 mm nickel, and the upper strap 17*c* is a stainless steel wire having a diameter of 0.16 mm.

The above construction is attractive because the discharge vessel 11, sleeve 21, and wire 22 can be provided during lamp assembly as a completed sub-assembly. The sub-assembly is then easily connected to the frame by welding the ends of the conductive feed-throughs 18 to the conductive support straps 17*c*, 17*d*, which are part of the conductive support rods. The use of clips on the press seal or straps about the sleeve which are welded to the support rod, as in U.S. Pat. Nos. 5,136,204 and 4,721,876, are eliminated, thus reducing lamp cost.

To test the effectiveness of the containment shield, the discharge vessel was made to explode by means of a current surge. The outer envelope was a standard, commercially available BD-17 bulb having a wall thickness which varies over its surface from about 0.6 mm to about 1 mm. The outer envelope remained entirely undamaged during this, which proves that the construction of the lamp effectively protects the surrounding against the consequences of an explosion of the discharge vessel. Using the same tests, the prior art lamp of FIG. 1 in which the sleeve was pinched to the major faces of the sleeve suffered breakage of the outer envelope even though its wall thickness was significantly greater, at about 2 mm.

Additionally, the lamp was drop tested to ensure the ruggedness of the fixation between the wire 22, the sleeve 21 and discharge vessel 11 as well as between the above sub-assembly and the frame at the welds between the conductive feed-throughs 18 and the conductive support rods 17*a*, 17*b* and straps 17*c*, 17*d*. In this standard drop test an outer cardboard box containing twelve (12) lamps in their commercial packaging is dropped a total of ten times from a height of thirty inches: six times with each one of the flat sides coming down first, twice with an edge coming down first, and twice with a corner coming down first. The lamps are then checked for breakage, bending of stem rods, etc. None of the lamps according to the invention were found to fail.

PHOTOMETRIC PERFORMANCE

The effectiveness of the sleeve construction at improving photometric performance was determined by fabricating low wattage metal halide lamps having a straight-body discharge vessel according to FIG. 3 and a sleeve construction according to FIG. 2. All of the lamps had conventional rod and coil electrodes.

Table I list the results for a group of 100 W metal halide lamps having a fill including sodium iodide and scandium iodide in a mole ratio of $NaI/ScI_3$ of 19:1. The cylindrical portion of the discharge vessel had an internal diameter of about 6 mm. The arc gap, the distance between the electrode tips (dimension A in FIG. 3), was about 13.5 mm. The cavity length (dimension B in FIG. 3) was about 23 mm.

Table II list the results for a group of 70 W metal halide lamp having a fill including sodium iodide and scandium iodide in a mole ratio of $NaI/ScI_3$ of 19:1. The cylindrical portion of the discharge vessel was also about 6 mm. The arc gap was about 10 mm and the cavity length was about 17 mm.

None of the Table I–II lamps had a heat conserving end coat about the end chambers. The outer envelopes had a gas fill of nitrogen, at a pressure of about 1 atmosphere during stable operation.

TABLE I

| Hrs | Volts | LPW | % LPW | CCT | CRI |
|---|---|---|---|---|---|
| 100 | 98 | 86 | | 3982 | 60 |
| 1000 | 98 | 80 | 93 | 3986 | 59 |
| 2000 | 98 | 74 | 86 | 3907 | 60 |
| 5000 | 99 | 59 | 69 | 3812 | 58 |

TABLE II

| Hrs | Volts | LPW | % LPW | CCT | CRI |
|---|---|---|---|---|---|
| 100 | 85 | 77 | | 4116 | 57 |
| 1000 | 86 | 74 | 96 | 4058 | 57 |
| 2000 | 87 | 65 | 85 | 3895 | 55 |
| 5000 | 89 | 50 | 65 | 4201 | 51 |

At 100 hours, each of the above lamps meets the design goal of "standard quality" photometrics, i.e. a CRI of about 60 and LPW of greater than about 80 for a 100 W lamp and greater than about 75 for a 75 W lamp. This was surprising because the discharge vessels did not have an end coat. There are no commercially available low wattage metal halide lamps having straight-body discharge vessel without an end coat. For the sake of comparison, a group of 100 W lamps having the same discharge vessel as those in Table I with a conventional $ZrO_2$ end coat and no sleeve had 100 hour values of 80 LPW and 60 CRI. One hundred watt lamps with the same discharge vessel with no end coat and no sleeve had 100 hour values of 75 LPW and 55 CRI. Thus, the sleeve design according to the invention (without an end coat) provides an improvement of 10 LPW and 5 CRI over lamps without a sleeve or end coat and at least the same improvement as that of a standard end coat. While it is generally known that a sleeve can improve photometric performance, the extent of the improvement was surprising. For the 100 W and 70 W lamps of Tables I–II, the radial distance between the minor face 14*c*, 14*d* and outer wall of the cylindrical portion 12 of the discharge vessel is about 2–3 mm, which is achieved during the standard pressing of the seals 14. The sleeve is selected to fit very closely to the minor faces so that it is also spaced only about 2–3 mm from the cylindrical portion. This close spacing is important to provide optimized heat conservation from the discharge vessel. The novel pinching along the minor faces permits of obtaining this close spacing with a simple construction which also minimizes conduction of heat away from the press seal end chamber areas.

Additionally, it was a surprise to find in several test groups that lamps without a $ZrO_2$ end coat on the end chambers experienced improved lumen maintenance as compared to lamps with such an end coat. From tables I–II, the lumen maintenance at 5000 hours was 69% and 65%, respectively, for 100 W and 70 W lamps as compared to a lumen maintenance of 52% for a 100 W lamp with the same discharge vessel and no sleeve but with a $ZrO_2$ end coat. Thus, in addition to the cost savings and reduced spread in photometric parameters among lamps, eliminating the end coat can also lead to improved lumen maintenance.

Those of ordinary skill in the art will appreciate that various modifications may be made to the above described embodiments which are within the scope of the appended claims. For that purpose the description is to be understood to be illustrative only and not limiting.

What is claimed is:

1. A high pressure discharge lamp comprising an outer envelope, a vitreous discharge vessel arranged within said outer envelope, said discharge vessel including a body portion enclosing a discharge space, an opposing pair of discharge electrodes within said body portion between which a discharge is maintained during lamp operation, and a pair of opposing seals sealing said discharge vessel in a gas-tight manner, each of said seals having a pair of opposing major faces and a pair of minor, side faces extending between said major faces, frame means for supporting said discharge vessel within said outer envelope and for electrically connecting said discharge vessel to a source of electric potential outside of said lamp envelope, and a light-transmissive sleeve arranged about said discharge vessel and having an end fixed directly to at least one of said seals, characterized in that:

said sleeve is fixed directly to said at least one seal along only said minor, side faces.

2. A high pressure discharge lamp according to claim 1, wherein said sleeve is fixed directly to both of said seals along only said minor, side faces.

3. A high pressure discharge lamp according to claim 2, wherein said sleeve is fixed directly to said minor, side faces by pinching.

4. A high pressure discharge lamp according to claim 2, wherein said discharge vessel includes a cylindrical body portion between said press seals.

5. A high pressure discharge lamp according to claim 4, wherein said discharge vessel includes end chambers extending between said cylindrical body portion and said press seals in which said discharge electrodes are arranged, and said discharge vessel is free of a heat conserving end coating on said end chambers and said seals.

6. A high pressure discharge lamp according to claim 5, wherein said side faces of each press seal include end portions remote from said end chambers, and said sleeve is pinched to said side faces only at said end portions, said sleeve not being pinched to said side faces between said end portions and said end chambers.

7. A high pressure discharge lamp according to claim 6, further comprising a helically coiled metal wire coiled about said sleeve, said length of wire being free of contact with any current carrying portions of said frame means.

8. A high pressure discharge lamp according to claim 7, wherein said coiled length of wire includes bent end portions at each end thereof, said bent end portions being bent over respective opposing ends of said sleeve for preventing axial movement of said coiled wire on said sleeve.

9. A high pressure discharge lamp according to claim 8, wherein said helically coiled metal wire has a clamping fit with said sleeve.

10. A high pressure discharge lamp according to claim 7, wherein said helically coiled metal wire is secured on said sleeve solely by a clamping fit with said sleeve.

11. A high pressure discharge lamp according to claims 6, wherein said discharge vessel includes a fill of mercury, a rare gas, and a metal halide, has a rated power of about 100 W, and has a luminous efficacy and color rendering of greater than about 80 LPW and greater than about 60 CRI, respectively.

12. A high pressure discharge lamp according to claim 6, wherein said discharge vessel includes a fill of mercury, a rare gas, and a metal halide, has a rated power of about 70 W, and has a luminous efficacy and color rendering of greater than about 75 LPW and greater than about 60 CRI, respectively.

13. A high pressure discharge lamp according to claim 1, wherein said containment shield further includes a helically coiled metal wire coiled about said sleeve, said length of wire being free of contact with any current carrying portions of said frame means.

14. A high pressure discharge lamp according to claim 13, wherein said helically coiled length of wire includes bent end portions at each end thereof, said bent end portions being bent over respective opposing ends of said sleeve for preventing axial movement of said coiled wire on said sleeve.

15. A high pressure discharge lamp according to claim 14, wherein said helically coiled metal wire has a clamping fit with said sleeve.

16. A high pressure discharge lamp according to claim 1, wherein said discharge vessel includes a cylindrical body portion between said press seals.

17. A high pressure discharge lamp according to claim 16, wherein:

said discharge vessel includes end chambers extending between said cylindrical body portion and said press seals and in which said discharge electrodes are arranged;

said discharge vessel is free of a heat conserving end coating on said end chambers and said seals; and said discharge vessel includes a fill of mercury, a rare gas, and a metal halide, has a rated power of about 100 W, and has a luminous efficacy and color rendering of greater than about 80 LPW and greater than about 60 CRI, respectively.

18. A high pressure discharge lamp according to claim 16, wherein:

said discharge vessel includes end chambers extending between said tubular body portion and said press seals and in which said discharge electrodes are arranged;

said discharge vessel is free of a heat conserving end coating on said end chambers and said seals; and said discharge vessel includes a fill of mercury, a rare gas, and a metal halide, has a rated power of about 70 W, and has a luminous efficacy and color rendering of greater than about 75 LPW and greater than about 60 CRI, respectively.

19. A high pressure discharge lamp according to claim 1, wherein said sleeve is fixed directly to said minor side face by pinching.

20. A metal halide discharge lamp, comprising:

a) an outer envelope sealed in a gas-tight manner;

b) a discharge vessel arranged within said outer envelope, said discharge vessel including a pair of opposing discharge electrodes between which a discharge arc is maintained during lamp operation, conductive feed-throughs extending from said discharge electrodes to the exterior of said discharge vessel, a pair of opposing press seals sealing said discharge vessel in a gas-tight manner, a discharge sustaining fill including mercury, a metal halide, and a rare gas, each of said press seals having a pair of opposing major faces and a pair of opposing minor, side faces extending between said major faces, each of said minor faces including an end portion remote from said discharge electrodes;

c) a lamp frame including first and second conductive support rods each connected to a respective one of said discharge vessel feed-throughs; and d) a containment shield disposed about said discharge vessel, said containment shield including a light-transmissive sleeve having opposing ends each adjacent a respective said press seal and a length of helically coiled wire coiled about said sleeve, said ends of said sleeve being pinched to said end portions of each of said minor, side faces, said sleeve not being pinched to said discharge vessel between the end portions at opposing ends of said discharge vessel, said discharge vessel and sleeve being supported within said outer envelope solely by said connection of said discharge vessel feed-throughs to said conductive support rods, and said sleeve and said helically coiled wire being free of contact with said lamp frame and being electrically isolated therefrom.

21. A high pressure discharge lamp according to claim 20, wherein said helically coiled length of wire includes bent end portions in each end thereof, said bent end portions being bent over respective opposing ends of said sleeve for preventing axial movement of said coiled wire on said sleeve.

22. A high pressure discharge lamp according to claim 21, wherein said helically coiled metal wire has a clamping fit with said sleeve.

* * * * *